US009493324B2

(12) United States Patent
Hashiuchi

(10) Patent No.: US 9,493,324 B2
(45) Date of Patent: Nov. 15, 2016

(54) DETACHER FOR ROLL AND IMAGE FORMING APPARATUS INCLUDING SAME

(71) Applicant: Koji Hashiuchi, Kanagawa (JP)

(72) Inventor: Koji Hashiuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 186 days.

(21) Appl. No.: 14/450,395

(22) Filed: Aug. 4, 2014

(65) Prior Publication Data

US 2015/0069169 A1 Mar. 12, 2015

(30) Foreign Application Priority Data

Sep. 12, 2013 (JP) ..... 2013-188928

(51) Int. Cl.

| | |
|---|---|
| ***B65H 19/22*** | (2006.01) |
| ***B65H 75/18*** | (2006.01) |
| ***B65H 19/12*** | (2006.01) |

(52) U.S. Cl.

CPC ..... *B65H 75/185* (2013.01); *B65H 19/126* (2013.01); *B65H 2301/418523* (2013.01); *B65H 2801/36* (2013.01)

(58) Field of Classification Search

CPC ..... B65H 19/22; B65H 19/2292

See application file for complete search history.

(56) References Cited

U.S. PATENT DOCUMENTS

| | | | | |
|---|---|---|---|---|
| 2003/0210312 | A1* | 11/2003 | Fujioka | B65H 16/06 347/102 |
| 2009/0194631 | A1* | 8/2009 | Genta | B41J 11/001 242/576 |
| 2012/0032021 | A1 | 2/2012 | Morinaga et al. | |
| 2013/0241142 | A1 | 9/2013 | Hashiuchi | |

FOREIGN PATENT DOCUMENTS

| | | | |
|---|---|---|---|
| CN | 1132716 | A | 10/1996 |
| CN | 101497405 | A | 8/2009 |
| CN | 102556727 | A | 7/2012 |
| CN | 103129176 | A | 6/2013 |
| JP | 2003-266837 | | 9/2003 |
| JP | 2003-266845 | | 9/2003 |
| JP | 2012-066932 | | 4/2012 |

OTHER PUBLICATIONS

Apr. 25, 2016 Chinese official action in connection with corresponding Chinese patent Application No. 201410461094.2.

* cited by examiner

*Primary Examiner* — Sang Kim

(74) *Attorney, Agent, or Firm* — Cooper & Dunham LLP

(57) ABSTRACT

A detacher for detaching from a roll a spool supporting the roll, and the detacher includes a detacher body; and a plurality of hooking parts disposed on a circumference of the detacher body to engage a plurality of projections of a flange disposed at an end of the spool. With the hooking parts engaging the projections of the flange, the roll and the detacher are relatively displaced so that the spool is detached from the roll.

8 Claims, 7 Drawing Sheets

DETACHER FOR ROLL AND IMAGE FORMING APPARATUS INCLUDING SAME

CROSS-REFERENCE TO RELATED APPLICATION

The present application claims priority pursuant to 35 U.S.C. §119(a) from Japanese patent application number 2013-188928, filed on Sep. 12, 2013, the entire disclosure of which is incorporated by reference herein.

BACKGROUND

1. Technical Field

Exemplary embodiments of the present invention relate to a detacher for a roll and an image forming apparatus employing the detacher for the roll.

2. Background Art

Among various types of image forming apparatuses including a printer, a facsimile machine, a copier, a plotter, and a multifunction apparatus combining several capabilities of the above devices, an inkjet recording apparatus is known as an image forming apparatus in which a recording head formed of a liquid discharge head (droplet discharge head) to discharge droplets is employed.

Some inkjet recording apparatuses employ printing media formed into a roll. Replacement of the roll involves removing the roll from a spool which is used for mounting the roll to the apparatus body, and mounting a new roll to the spool.

However, because the roll is usually heavy and difficult to handle and does not fit in the spool due to a slight change in an inner diameter of the roll, the spool may not always be removed easily.

SUMMARY

In one embodiment of the disclosure, there is provided a detacher for detaching from a roll a spool supporting the roll, and the detacher includes a detacher body; and a plurality of hooking parts disposed on a circumference of the detacher body to engage a plurality of projections of a flange disposed at an end of the spool. With the hooking parts engaging the projections of the flange, the roll and the detacher are relatively displaced so that the spool is detached from the roll.

In one embodiment of the disclosure, there is provided an image forming apparatus including the spool to support the roll and the detacher to detach the spool from the roll.

These and other objects, features, and advantages of the present invention will become apparent upon consideration of the following description of preferred embodiments of the present invention when taken in conjunction with the accompanying drawings.

DETAILED DESCRIPTION

Preferred embodiments of the present invention will be described with reference to accompanying drawings.

First, referring to FIGS. 1 to 3, an image forming apparatus employing a roll to which a detacher for the roll according to an embodiment of the present invention is applied, will be described.

Figure 1:
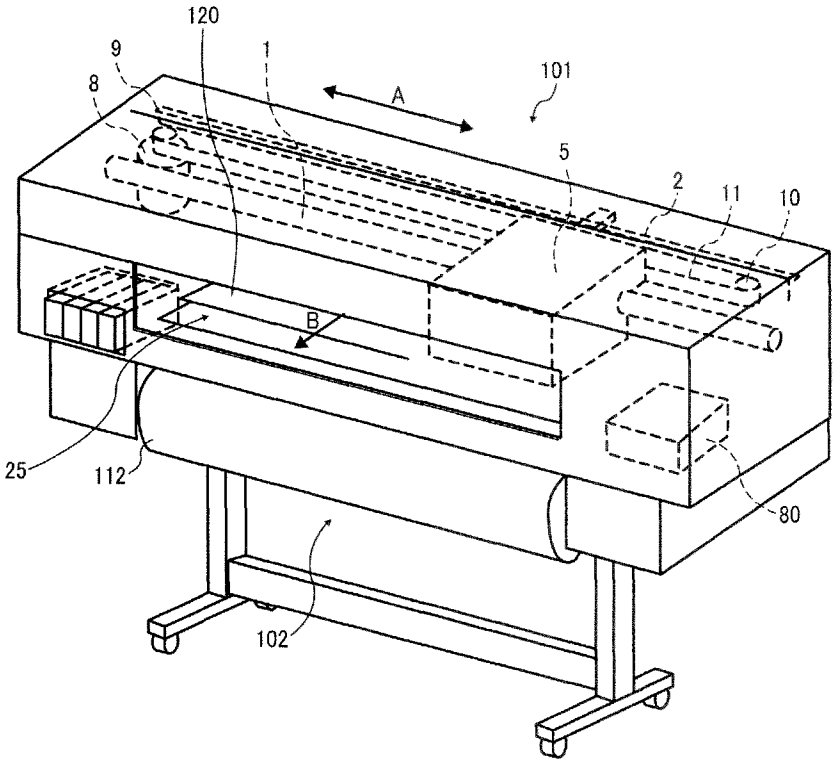
FIG. 1 is a perspective view of an image forming apparatus employing a roll to which a detacher for a roll according to an embodiment of the present invention is applied.

FIG. 1 is a perspective view of the image forming apparatus; FIG. 2 is a schematic side view; and FIG. 3 is an explanatory plan view of a main part of the image forming apparatus.

The present image forming apparatus is a serial-type image forming apparatus, and is constructed of an apparatus body 101 and a roll feeder 102 disposed below the apparatus body 101. The roll feeder 102 here is disposed below the apparatus body 101 separating from the apparatus body 101; however, FIG. 1 shows the roll feeder 102 integral with the apparatus body 101 for simplifying the structure.

The apparatus body 101 includes an image forming section 103 to form an image on a paper roll 120 fed from the roll feeder 102.

The image forming section 103 includes a guide rod 1 and a guide stay 2, both supported by lateral side plates, not shown. The image forming section 103 further includes a carriage 5, which is reciprocally movable along and supported by the guide rod 1 and the guide stay 2 in Arrow A direction (that is, in a main scanning direction and carriage moving direction) (see FIG. 1).

In addition, a main scanning motor 8 as a drive source to move the carriage 5 reciprocally is disposed at one end of the carriage 5 in the main scanning direction. A driving pulley 9 is rotatably driven by the main scanning motor 8 and a driven pulley 10 is disposed at the other end of the carriage 5 in the main scanning direction. A timing belt 11 is stretched around a portion between the driving pulley 9 and the driven pulley 10. The carriage 5 includes a belt holder, not shown. The belt holder of the carriage 5 is fixed to the timing belt 11, so that the carriage 5 is moved back and forth in the main scanning direction by driving the main scanning motor 8.

A plurality of recording heads 6*a* to 6*d* (four in the present embodiment), in which each liquid discharge head and a head tank to supply liquid to the head are integrally formed, is mounted to the carriage 5. The recording heads are collectively denoted simply as the recording head 6.

Figure 3:
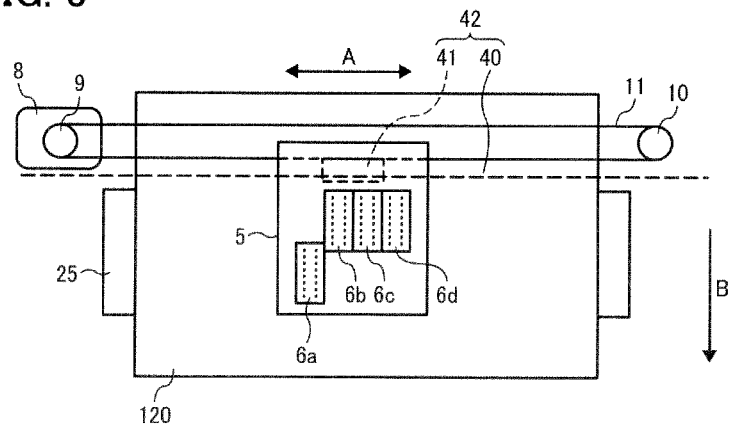
FIG. 3 is an explanatory plan view of a main part of the image forming apparatus in FIG. 1.

Herein, as shown in FIG. 3, the recording head 6*a* on the one hand and the recording heads 6*b* to 6*d* on the other are staggered by the length of one head in a sub-scanning direction a perpendicular to the main scanning direction. In addition, the recording head 6 includes nozzle arrays, each including a plurality of nozzles to discharge droplets. The nozzle arrays are disposed along the sub-scanning direction perpendicular to the main scanning direction, with a droplet discharging direction oriented downward.

The recording heads 6*a* to 6*d* each include two nozzle arrays. Then, the recording heads 6*a* and 6*b* discharge black droplets from both corresponding nozzle arrays. One of the nozzle arrays of the recording head 6*c* discharges droplets of cyan (C) color and the other nozzle array is set as an unused nozzle row. One of the nozzle arrays of the recording head 6*d* discharges droplets of yellow (Y) and the other discharges droplets of magenta (M), respectively.

With such a structure, a monochrome image is formed using the recording heads 6*a* and 6*b* with a width of double heads by one scan in the main scanning direction; by contrast, a color image is formed with recording heads 6*b* to 6*d*. The head structure is not limited to an embodiment described above, but the plurality of recording heads may be disposed side by side all along the main scanning direction.

Ink of each color is supplied from an ink cartridge as a main supply tank replaceably attached to the apparatus body 101 to the head tank of the recording head 6 via a supply tube.

In addition, an encoder sheet 40 is disposed along the moving direction of the carriage 5. The carriage 5 includes an encoder sensor 41 to read the encoder sheet 40. A linear encoder 42 is formed of the encoder sheet 40 and the encoder sensor 41. The position and speed of the carriage 5 can be obtained from output from the linear encoder 42.

On the other hand, in the recording area among the main scanning areas of the carriage 5, the paper roll 120 is fed from the roll feeder 102, and is conveyed intermittently by a conveyance unit 21 in the direction perpendicular to the main scanning direction of the carriage 5, that is, in the sub-scanning direction and the conveyance direction as indicated by Arrow B.

The conveyance unit 21 includes a conveyance roller 23 and a pressure roller 24 disposed opposite the conveyance roller 23 to convey the paper roll 120 fed from the roll feeder 102. The conveyance unit 21 includes a conveyance guide 25, disposed downstream of the conveyance roller 23, including a plurality of suction holes. The conveyance unit 21 further includes a suction fan 26 to suck air from the suction holes of the conveyance guide 25.

Figure 2:
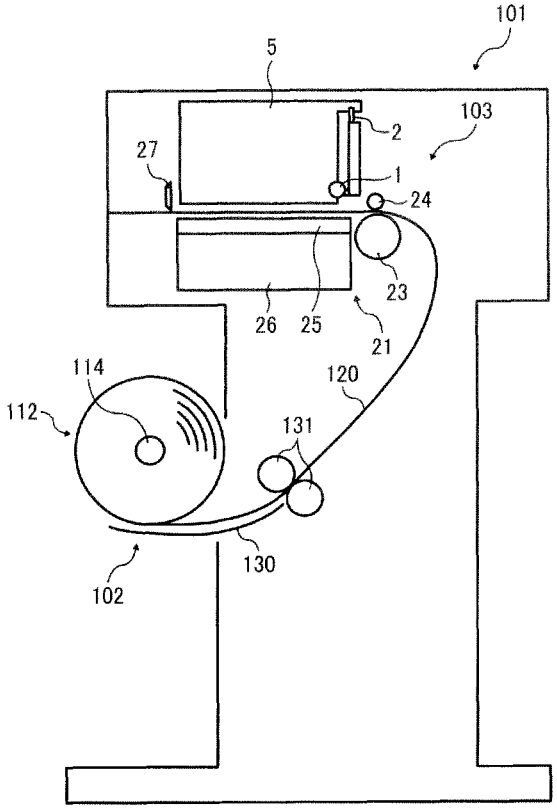
FIG. 2 is a schematic side view of the image forming apparatus in FIG. 1.

A cutter 27 is disposed downstream of the conveyance unit 21 as illustrated in FIG. 2. The cutter 27 cuts the paper roll 120 on which images are formed by the recording head 6 to a predetermined length.

Further, a maintenance unit SO to perform maintenance of the recording head 6 is disposed at one side in the main scanning direction of the carriage 5 and at a side of the conveyance guide 25.

The roll 112 includes a tube 114 as a metal core and a roll of paper and is referred to as the paper roll 120.

Herein, according to the present embodiment, the roll 112 including the paper roll 120 can be attached to the roll feeder 102 in either case in which a trailing end of the paper roll 120 is adhered to the tube 114 with an adhesive agent or is not adhered thereto.

In addition, a guide member 130 to guide the roll 112 when the paper roll 120 is taken out of the roll feeder 102 and a conveyance roller pair 131 to convey the paper roll 120 in an upward curve are disposed at the side of the apparatus body 101.

By rotating the conveyance roller pair 131, the paper roll 120 is fed out from the roll 112 and is conveyed in a state stretched between the conveyance roller pair 131 and the roll 112. The paper roll 120 passes through the conveyance roller pair 131 and is sent to a portion between the conveyance roller 23 and the pressure roller 24 of the conveyance unit 21.

In the thus-configured image forming apparatus, the carriage 5 is moved in the main scanning direction and the paper roll 120 supplied from the roll feeder 102 is intermittently conveyed by the conveyance unit 21. Then, the recording head 6 is driven in accordance with image or print data to cause the droplets to be discharged, thereby forming a predetermined image on the paper roll 120. The paper roll 120 on which the image is formed is cut at a predetermined length by the cutter 27, is guided by a paper ejection guide, not shown, disposed at a front of the apparatus body 101, and is ejected into a bucket and stored therein.

Next, a spool supporting the roll 112 included in the image forming apparatus will be described referring to FIGS, 4 and 5.

Figure 4:
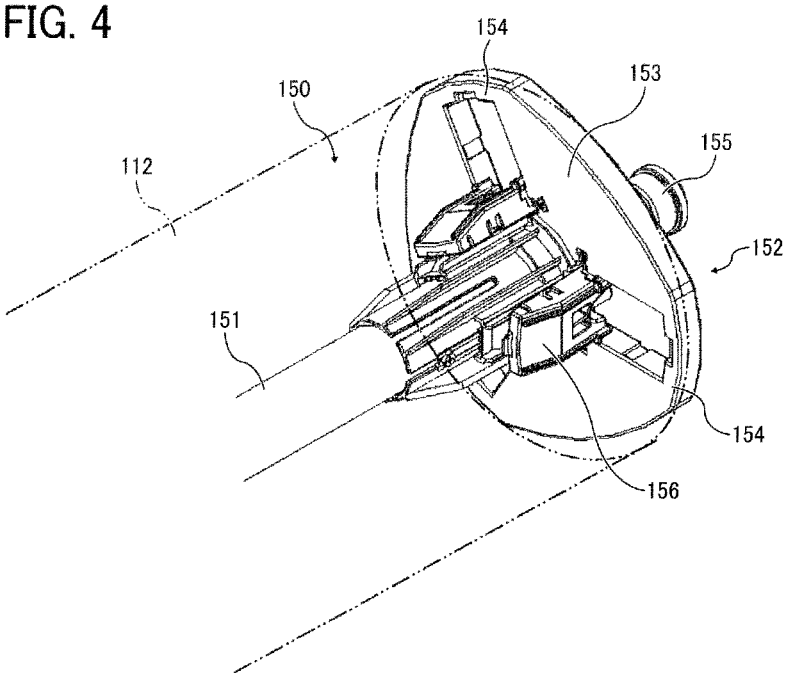
FIG. 4 is a perspective view illustrating an edge portion of a spool supporting the roll.
Figure 5:
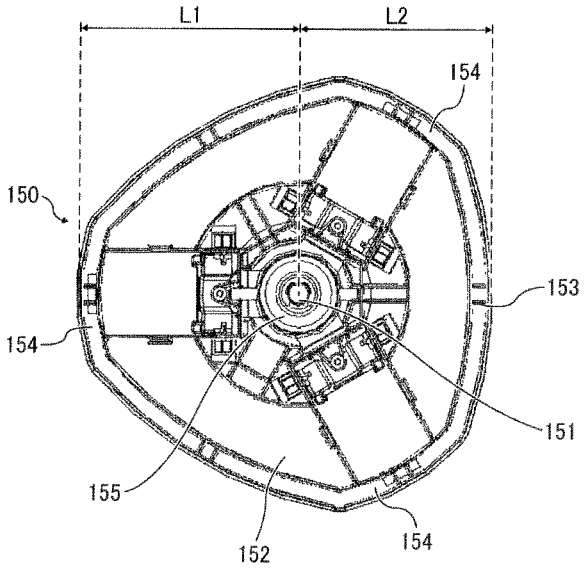
FIG. 5 is a side view of the spool of FIG. 4.

FIG. 4 is a perspective view illustrating an edge portion of the spool and FIG. 5 is a side view of the spool.

The spool 150 includes a flange 152 disposed at an edge of the shaft member 151 into which a core tube of the roll 112 is inserted.

In addition, the flange 152 includes three projections 154 which are equi-angularly positioned along the circumference of or around the axial center of the spool 150. Specifically, a length L1 from the center to the periphery of the projections 154 is longer than a length L2 from the center to a peripheral portion 153 between adjacent projections 154.

In addition, a gear 155 to be connected to a drive source, not shown, of the roll feeder 102 is disposed at an end of the shaft member 151 of the spool 150.

In addition, the flange 152 includes a shaft core support 156. The shaft core support 156 contacts an inner periphery of the core tube of the roll 112 to support the roll 112.

Next, a detacher 200 for the roll according to the present embodiment will be described referring to FIGS. 6 and 7.

Figure 6:
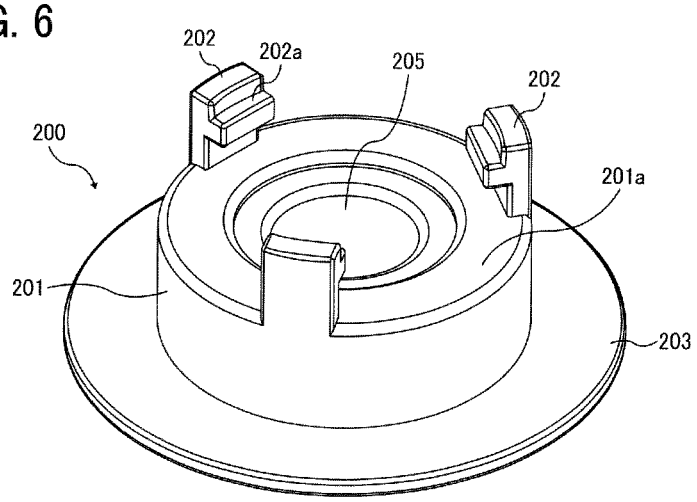
FIG. 6 is a perspective view of an exemplary detacher as a tool for the roll according to an embodiment of the present invention.
Figure 7:
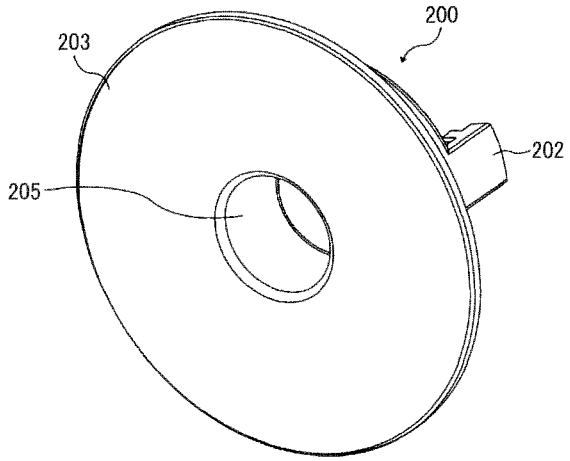
FIG. 7 is a perspective view illustrating a bottom side of the detacher.

FIG. 6 is a perspective view illustrating the detacher 200 for the roll and FIG. 7 is a perspective view of the detacher 200 seen from a bottom side thereof.

The detacher 200 for the roll is used when removing the spool 150 supporting the roll 112 from the roll 112.

The detacher 200 for the roll 112 includes a detacher body 201 including a receiving surface 201*a* that receives the flange 152 of the spool 150 in the axial direction.

A plurality of hooking parts 202 are disposed along the outer circumference of the receiving surface 201*a* of the detacher body 201.

Furthermore, the hooking parts 202 includes stepped portions 202*a*. The stepped portions 202*a* are disposed at positions which an outer circumference of the roll 112 fits into. There is a gap between the stepped portions 202*a* of the hooking parts 202 and the receiving surface 201*a*, into which the flange 152 of the spool 150 can be fitted. Further, the three hooking parts 202 are equi-angularly located like the projections 154 of the flange 152.

A flange 203 having a diameter larger than that of the detacher body 201 is formed opposite the receiving surface 201*a* of the detacher body 201. The flange 203 is used to step on when removing the spool 150, so that the flange 203 has a relatively large diameter.

Further, the detacher body 201 includes a central hollow portion 205 through which the gear 155 disposed at the end of the spool 150 enters without any interference.

Next, removing the spool 150 from the roll 112 using the thus-configured detacher 200 for the roll 112 will be described with reference to FIGS. 8 to 10.

Figure 8:
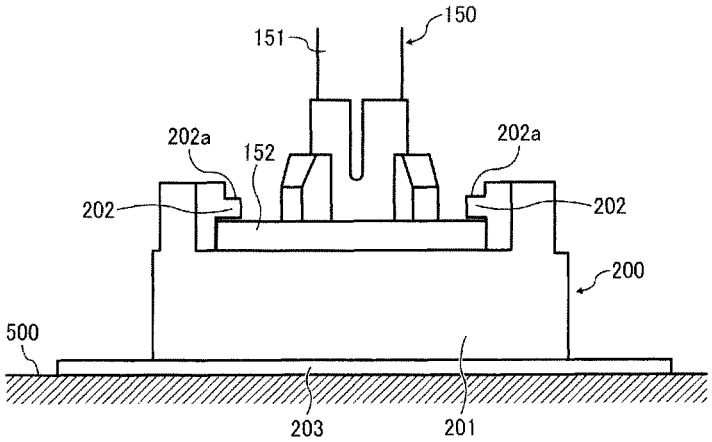
FIG. 8 is an explanatory plan view illustrating how to detach the spool using the detacher according to the present embodiment.

FIG. 8 is an explanatory plan view illustrating how to detach the spool using the detacher; FIG. 9 is a perspective view of a main part of the detacher seen from the spool; and FIG. 10 is a perspective view illustrating a main part of the detacher for the roll seen from a bottom side thereof.

First, the detacher 200 for the roll is placed on a floor 500. Then, the roll 112 mounted on the spool 150 is removed from the image forming apparatus. With the roll 112 standing on the wall, the flange 152 of the spool 150 is contacted against the receiving surface 201*a* of the detacher body 201 of the detacher 200 for the roll 112 from an axial direction. Herein, the peripheral portion 153 of the flange 152 is opposed to the hooking parts 202.

Figure 9:
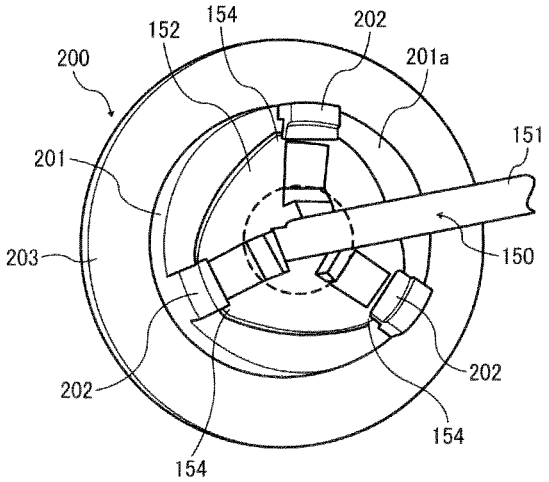
FIG. 9 is a perspective view of a main part of the detacher seen from the spool.

In the above state, the spool 150 is rotated together with the roll 112, and the projections 154 of the flange 152 are caused to get hung up on the hooking parts 202 as illustrated in FIGS. 8 and 9.

The flange 203 of the detacher body 201 is then stepped on, so that the roll 112 can be lifted up and the roll 112 is displaced in the axial direction relative to the detacher 200 for the roll. Then, the spool 150 remains at a side of the detacher 200 for the roll, so that the spool 150 can be removed from the roll 112.

Figure 10:
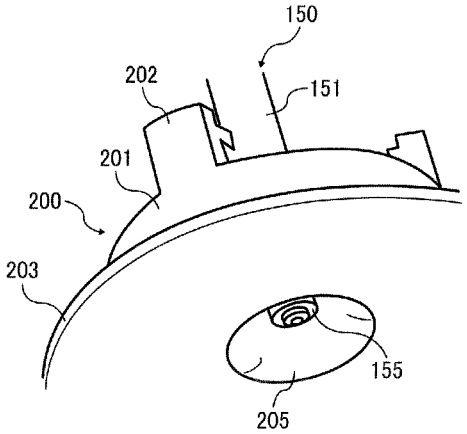
FIG. 10 is a perspective view illustrating the main part of the detacher for the roll seen from a bottom side thereof.

In this case, because the gear 155 of the spool 150 enters into the hollow portion 205 of the detacher body 201 as illustrated in FIG. 10, the gear 155 is prevented from being damaged.

According to the present invention, removability of the roll from the spool is improved with the use of the detacher 200 of the embodiment of the present invention.

Figure 11:
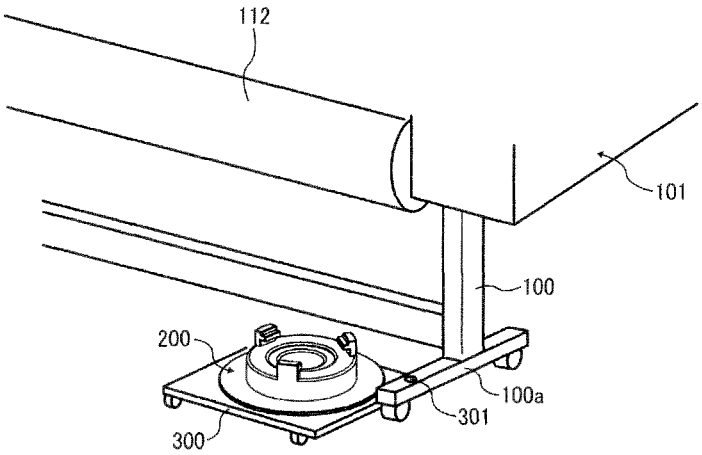
FIG. 11 is a perspective view of a main part of the image forming apparatus employing the detacher for the roll.
Figure 12:
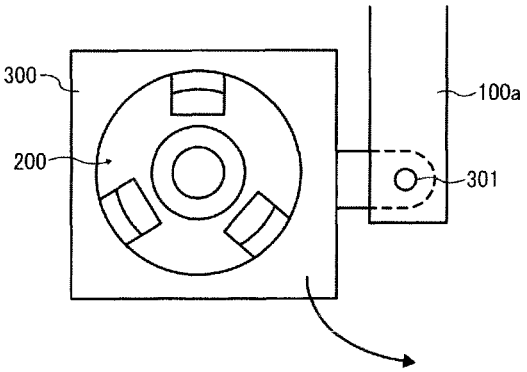
FIG. 12 is a plan view of the detacher for the roll of FIG. 11.

An example in which the detacher 200 for the roll is employed in the image forming apparatus will be described referring to FIGS. 11 and 12. FIG. 11 shows a perspective view illustrating how to provide the detacher for the roll with the image forming apparatus and FIG. 12 shows a plan view of FIG. 11.

In the present example, a detacher receiving member 300 is pivotally attached with a shaft 301 on a leg portion 100*a* of a stand rack 100 supporting the apparatus body 101.

Then, the detacher 200 for the roll is placed with face up on the detacher receiving member 300.

When the thus-constructed detacher receiving member 300 is used, because it is disposed near the apparatus body 101, the detacher can be used easily and is not lost when not in use.

Because the detacher 200 for the roll s disposed below the apparatus body 101, the detacher 200 for the roll can be used as is.

Further, because the detacher 200 for the roll is placed with face up, the weight of the detacher body 201 can be used as a pull-off power, so that the detacher body 201 can be pulled out with a less force.

When the detacher 200 for the roll is pivotally fixed on the detacher receiving member 300, the detacher 200 for the roll can be used by sliding out by rotating it in the arrow direction in FIG. 12 and is installed when not used, so that a space can be used effectively.

In this patent specification, the term "roll" is a collective term for a recorded medium, recording medium, recording sheet, and the like and is not limited to the paper material, but also includes an OHP sheet, fabrics, boards, etc., on which ink droplets or other liquid are deposited. The term "image formation" means not only recording, but also printing, image printing, and the like.

The term "image forming apparatus" means an apparatus to perform image formation by impacting droplets to various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

The term "ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

The embodiments described above are applied to the image forming apparatus using the paper roll, but may be used similarly for the image forming apparatus using sheets of paper.

Additional modifications and variations of the present invention are possible in light of the above teachings. It is therefore to be understood that, within the scope of the appended claims, the invention may he practiced other than as specifically described herein.

What is claimed is:

1. A detacher for detaching a spool that is attached to a roll, from the roll, the detacher comprising:

a detacher body; and a plurality of hooking parts disposed to contact a circumference of a flange disposed at an end, in an axial direction, of the spool and to engage a plurality of projections of the flange, wherein, with the hooking parts engaging the projections of the flange, the detacher body contacts a side of the flange opposite to that facing the spool, and the roll and the detacher are relatively displaced so that the spool is detached from the roll.

2. The detacher as claimed in claim 1, wherein the hooking parts and the detacher body define a gap dimensioned to accommodate the projections of the flange.

3. The detacher as claimed in claim 1, wherein the detacher body comprises a hollow portion dimensioned to accommodate a gear disposed at an end of a shaft member of the spool.

4. The detacher as claimed in claim 1, further comprising a flange having a diameter larger than a diameter of an outer circumference of the plurality of hooking parts of the detacher body.

5. An image forming apparatus comprising:

the spool to support the roll; and the detacher as claimed in claim 1 to detach the spool that is attached to the roll, from the roll.

6. The image forming apparatus as claimed in claim 5, wherein the detacher is disposed at a bottom portion of an apparatus body of the image forming apparatus.

7. The image forming apparatus as claimed in claim 5, wherein the detacher is disposed with the hooking parts facing upward.

8. The image forming apparatus as claimed in claim 5, wherein the detacher is movable.

* * * * *